United States Patent [19]

Matkan et al.

[11] Patent Number: 5,055,365

[45] Date of Patent: Oct. 8, 1991

[54] ELECTROSTATIC PROOFING OF NEGATIVE COLOR SEPARATIONS

[75] Inventors: Josef Matkan, Malvern; John T. Alston, Myrtle Bank, both of Australia

[73] Assignee: Stork Colorproofing B.V., Boxmeer, Netherlands

[21] Appl. No.: 276,771

[22] Filed: Nov. 28, 1988

[30] Foreign Application Priority Data

Dec. 1, 1987 [AU] Australia ..... PI5694

[51] Int. Cl.[5] ..... G03G 13/01

[52] U.S. Cl. ..... 430/42; 430/44

[58] Field of Search ..... 430/44

[56] References Cited

U.S. PATENT DOCUMENTS 4,764,443 8/1988 Matkan ..... 430/45

4,804,602 2/1989 Buettner et al. ..... 430/42

*Primary Examiner*—Marion E. McCamish

*Assistant Examiner*—S. Crossan

*Attorney, Agent, or Firm*—Myron C. Cass

[57] ABSTRACT

An image reversal process for the production of electrophotographic color proofs from negative separation films where the photoconductive recording member is reusable and the proofs are produced on printing stock paper and which very closely match the appearance of the printed sheet.

The process of the invention comprises, exposing a photoconductor that is charged to a first polarity through a color separation negative film which may be in contact therewith, developing the unexposed areas on the photoconductor with opposite polarity background toner to form background deposits thereon in areas corresponding to the opaque non-image or background areas on the negative, subjecting the photoconductor and the background deposits thereon to corona discharge of said first polarity to charge the photoconductor in the areas free of said background deposits, that is, in areas corresponding to the transparent image areas on the negative, removing charges of said first polarity from the background deposits, developing the image area on the photoconductor with opposite polarity color toner, and transferring the thus formed color toner deposits to a receptor such as printing stock paper. The process can be repeated for each additional color separation negative film to transfer the additional specific color developed image in proper registry where a proper toner for the specific color image will be used.

28 Claims, 3 Drawing Sheets

ELECTROSTATIC PROOFING OF NEGATIVE COLOR SEPARATIONS

FIELD OF THE INVENTION

This invention relates generally to electrophotography and, in particular, to a novel method of preparing multicolor pre-press proofs from negative color separation films by an electrophotographic process.

BACKGROUND OF THE INVENTION

The purpose of pre-press proofs is to enable one to assess the color balance, registration, appearance, among other features, which can be expected from the press run and to correct the separation films before the printing plates are made therefrom. It is also desirable to produce so-called "customer proofs" which tell the customer how the original artwork will appear when printed with plates made from the separation films. Thus, it is essential that the pre-press proof have the same appearance as the press print. Accordingly, in addition to matching the color balance of the press print, the customer proof should be on the same paper as the press print.

The separation film can be a positive film or a negative film, depending on the type of printing plate to be used. The printing plate used can be the so-called positive working and negative working lithographic or offset printing plate as is known in this field. A positive working plate is exposed to light through a film positive on which the information to be printed corresponds to opaque areas and the non-printing background areas correspond to transparent areas. The exposed areas on the plate are rendered removable by chemical treatment and the underlying plate surface, usually grained aluminum, forms the water receptive non-printing or non-image areas, whereas the unexposed areas form the ink receptive printing image areas. A negative working printing plate is exposed to light through a film negative on which the information to be printed corresponds to transparent areas and the non-printing background areas correspond to opaque areas. In this case, the exposed areas on the plate become photo-hardened and form the ink receptive printing areas, whereas the unexposed areas are removed by chemical treatment and the underlying water receptive plate surface forms the non-printing or non-image areas.

It is also known to produce, by electrophotographic processes, lithographic and gravure pre-press proofs containing in general four colors, such as yellow, magenta, cyan and black. Such pre-press proofing processes are disclosed, for example, in U.S. Pat. Nos. 3,809,555 and 3,862,848. An apparatus for the production of electrophotographic pre-press proofs is described, for example, in U.S. Pat. Nos. 4,556,309 and 4,557,583.

It is known that electrophotographic pre-press proofs can be produced by charging a photoconductive recording member, followed by exposure through a separation film positive corresponding to one color, followed by toning of the exposed photoconductor with a liquid dispersed toner of the appropriate color, followed by in-register transfer of the color toned image deposit directly or through an intermediate or offset member to a receptor, such as paper usually of the same grade as the printing stock. These process steps are then repeated with separation film positives of the other three or more colors and appropriate color toners to produce a multicolor proof.

After all of the required color toner deposits have been transferred to the receptor paper, it is coated by spraying or other methods with a clear polymer layer to transparentize the color toner deposits and fuse them to the receptor paper sheet.

All of the above referred to prior art electrophotographic proofing processes are so-called direct reproduction processes. Accordingly, the color separation films employed can comprise film positives only, and thus, these processes are not suitable for the proofing of negative separation films wherein a reverse reproduction process is required.

Methods of electrophotographic image reversal, that is, production of a positive image from a negative film, are known, for example, as taught in U.S. Pat. No. 3,300,410 and United Kingdom Patent No. 998,599.

U.S. Pat. No. 3,300,410 discloses a photoconductive recording member that consists of a sheet of paper that is coated with photoconductive zinc oxide and charged to negative polarity. The sheet was exposed through a negative film and toned with a positive liquid toner having film forming colloidal size conductive resin particles to form, after evaporation of the carrier liquid of such toner and drying, a permanently fixed conductive and colorless film deposit in the unexposed or non-image areas. The sheet was then re-charged negatively and only image areas free of conductive colorless film deposit accepted charges. These areas were then toned with a colored positive toner to form visible image deposits, whereby a reversal image or a positive reproduction of the negative film was obtained. Since the conductive film deposit affixed in the non-image areas was colorless, it did not affect the appearance of the zinc oxide coating.

United Kingdom Patent No. 998,599 discloses an image reversal that was obtained on a sheet of paper coated with photoconductive zinc oxide in a similar manner as described above. However, a positive liquid toner comprising low tinting strength pigment particles was used to form, in the unexposed or non-image areas upon evaporation of the carrier liquid for such toner by drying, a permanently fixed conductive deposit. The deposit did not accept charge during the subsequent step of re-charging the surface for toning with a colored toner to form visible image deposits. Again, since the conductive deposit affixed in the non-image areas had a low tinting strength, it did not affect the appearance of the photoconductor. The low tinting strength materials used were alumina hydrate, magnesium and barium carbonates, talc, plaster of Paris, conductive zinc oxide, mica and silica, having a refractive index less than about 1.6 or 1.7 and an electrical volume resistivity less than about $10^9$ ohmcm.

In each of the above cases, the colorless or low tinting strength toner deposits were conductive and thus did not accept charges. Since these toner deposits were permanently affixed to the photoconductor surface, these processes are suitable only for single color reproduction on disposable photoconductors and are not suitable for applications wherein images are produced successively in a variety of colors on a reusable photoconductor and then transferred therefrom onto a receptor.

SUMMARY OF THE INVENTION

This invention provides an image reversal process for the production of electrophotographic color proofs from negative separation films wherein the photoconductive recording member is reusable and wherein the proofs are produced on printing stock paper, very closely matching the appearance of the printed sheet.

The process of the invention includes exposing a photoconductive that is charged to a first polarity through a color separation negative film which may be in contact therewith, developing the unexposed areas on the photoconductor with opposite polarity background toner to form background deposits thereon in areas corresponding to the opaque non-image or background areas on the negative, subjecting the photoconductor and the background deposits thereon to corona discharge of said first polarity uniformly to charge the photoconductor in the areas free of said background deposits, that is, in areas corresponding to the transparent image areas on the negative, removing charges of said first polarity from the background deposits, developing the image areas on the photoconductor with opposite polarity color toner, and transferring the thus formed color toner deposits to a receptor such as printing stock paper. Prior to development with the color toner, the charges are removed from the background deposits to ensure that no color toner will be attracted thereto, since any color toner contained on the background deposits would transfer onto the receptor and form thereon objectionable fog in the non-image or background areas. The background deposits are not adhesively affixed to the photoconductor, yet do not transfer to the receptor but can be easily removed from the photoconductor when desired.

For each additional color separation negative film, the process is repeated for the development and transfer of the additional specific color developed image in proper registry. Of course, a proper toner for the specific color image will be used.

The above described process of this invention includes, in essence, the steps of:

1. uniformly charging a reusable photoconductor to a first polarity;

2. exposing the photoconductor to light through a negative separation film of the first color;

3. toning the photoconductor with opposite polarity liquid toner, henceforth referred to as background toner, to form in unexposed areas thereon a background deposit which:

upon drying remains on the photoconductor without being adhesively affixed thereto, is chargeable to positive and negative polarity, has a lower capacitance than the photoconductor, is substantially not transferable electrostatically or is transferable only at substantially higher voltage than the color toners used in the process as referred to further below, and upon transfer to the receptor becomes fully transparent when a clear polymer film is formed over same;

4. drying the background deposit;

5. optionally applying charges of opposite polarity to the photoconductor and the background deposit to thereby induce charges of opposite polarity only on the background deposit;

6. uniformly charging the photoconductor and the background deposit to the first polarity, wherein the first polarity charges induced on the background deposit are limited by the opposite polarity charges induced thereon in preceding step 5;

7. applying uniformly charges of opposite polarity to the photoconductor and the background deposit, wherein the magnitude of the opposite polarity charges is selected to substantially reduce the first polarity charges on the background deposit in view of its lower capacitance and optionally induce charges of opposite polarity thereon, without substantially affecting the first polarity charges on the photoconductor in view of its higher capacitance;

8. toning the photoconductor with opposite polarity liquid toner of the first color to form color deposits thereon in image areas free of the background deposit;

9. transferring such color deposits directly or through an offset member onto a receptor such as proof paper;

10. optionally, while employing the background deposit formed in steps 3 and 4, repeating steps 5 to 9 the required number of times if multiple proofs are needed;

11. removing the background deposit from the photoconductor;

12. repeating steps 1 to 9 and 11, and optionally step 10, with negative separation films of subsequent colors and liquid toners of corresponding colors;

13. drying the receptor; and 14. forming a clear polymer film on the receptor paper, at least in the areas containing color toner deposits thereon.

DESCRIPTION OF THE PREFERRED EMBODIMENT

Figure 1:
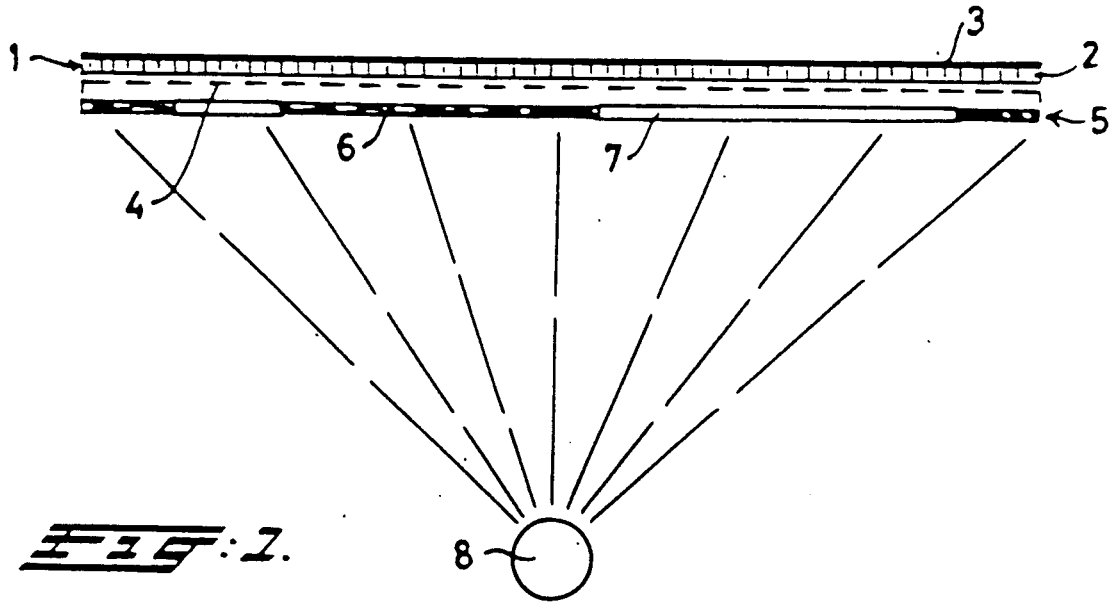
FIG. 1 is a diagrammatic sectional view taken through a photoconductor and separation film illustrating the first step of forming a color proof in accordance with a method of the invention.

Applicant has discovered that particulate materials of the type disclosed in United Kingdom Patent No. 998,599 referred to above are not truly conductive, per se, and if incorporated in toner compositions as hereinafter described, are useful for making background toners in accordance with this invention to form background deposits which differ very significantly from the low tinting strength toners of United Kingdom Patent No. 998,599. The background deposits formed in accordance with this invention:

are non-conductive and are thus chargeable, yet easily dischargeable;

are not adhesively affixed to the photoconductor;

are substantially not transferable; and can be easily cleaned off the photoconductor to render it reusable.

Certain other substances that were found to be useful in making background toners in accordance with this invention include particulate material such as calcium carbonate, micronic size celluloses such as methyl cellulose and carboxy methyl cellulose, polymeric materials such as polyvinyl pyrollidone, polyvinyl alcohol and calcium resinate, carbohydrates such as starch and dextrin, silicates such as bentonite, asbestine and montmorillonite, clays such as kaolin and attapulgus clay and the like, as well as dielectric or highly insulative polymeric materials in particulate form, which are insoluble in the carrier liquid, such as epoxies, acrylics, polyvinyl chloride, polyvinyl acetate, polyvinyl butyral, polyesters, polystyrene, polyethylene and the like. Mixtures of these materials can also be used.

The background toner of this invention is prepared by dispersing particulate materials of the above disclosed type in the toner carrier liquid such as isoparaffinic hydrocarbon in the presence of a soluble dispersing aid or wetting agent such as acrylic polymer, rosin ester and the like. A charge director or polarity control agent can be included in the dispersion. To prevent adhesion of the background deposit to the photoconductor, the proportion of such dispersing aid is kept at a minimum, such as not more than about 25 percent by weight of the particulate material. Furthermore, to prevent electrostatic transfer of the background deposit, no transfer enhancing materials such as waxes or lattice forming substances are included in the background toners of this invention.

The background deposits formed by the above disclosed background toners of this invention remain, upon drying, on the photoconductor surface due to the presence of the small proportion of the soluble dispersing aid, without becoming affixed thereto. Therefore, they can be applied to reusable photoconductors and can be very easily removed therefrom when desired.

Although such background deposits are not affixed to the photoconductor, they are electrostatically substantially not transferable, at least not at transfer voltages normally used in the process for the color toners. At higher voltages some random transfer of the background deposit may occur, without, however, affecting the appearance of the receptor. This is because the above disclosed particulate materials become fully transparent when the aforementioned clear polymer film is formed on the receptor.

A further essential requirement of the background deposit of this invention is that its capacitance must be substantially lower than that of the photoconductor. This is accomplished by the above disclosed toner composition, wherein the proportion of the dispersing aid is insufficient not only to affix the toner deposit to the photoconductor but also to cement together the individual toner particles and thereby to form a continuous layer. Thus the deposit is discontinuous, in that it comprises substantially discrete weakly coherent particles having voids or air pockets therebetween. The capacitance of a background deposit layer having such a structure, irrespective of the layer thickness and of the dielectric constant of the materials contained therein, is per se lower than the capacitance of the commonly known continuous layer photoconductors.

As stated earlier, the background deposit of this invention can be charged positively and negatively. However, the rate of decay of the charge accepted by the background deposit is, due to its low capacitance, significantly faster than the rate of dark decay of the charge accepted by the photoconductor. Also, if both the background deposit and the photoconductor are charged to one polarity, application of weak charges of opposite polarity will readily discharge the background deposit, due to its low capacitance and consequently low surface charge density, without significantly affecting the charge on the photoconductor.

The process of this invention will now be described in more detail with reference to the drawings, where, for illustrative purposes, operation with only a negatively chargeable n-type photoconductor is shown. It is to be understood, however, that the process is equally applicable to positively chargeable p-type photoconductors, in which case charges of opposite polarity to those shown in the drawings would be used throughout the process steps.

Referring now to FIG. 1, a photoconductor is designated generally by reference numeral 1. The photoconductor 1 includes a photoconductive layer 2 that is secured to a conductive substrate 3. The photoconductor 1 is uniformly charged to a negative polarity as indicated by negative charges 4. A first color negative separation film 5, containing opaque non-image or background areas 6 and transparent image areas 7, is placed in contact with the photoconductor 1 for contact exposure through a light source 8.

Figure 2:
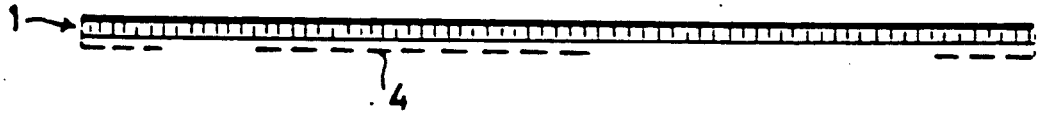
FIG. 2 is a diagrammatic sectional view taken through a photoconductor illustrating the second step of forming a color proof in accordance with a method of the invention.

FIG. 2 illustrates the photoconductor 1 after exposure by the light source 8. The photoconductor 1 retains the negative electrostatic charges 4 only in the areas corresponding to the opaque background areas 6 of the negative film 5 illustrated in FIG. 1.

Figure 3:
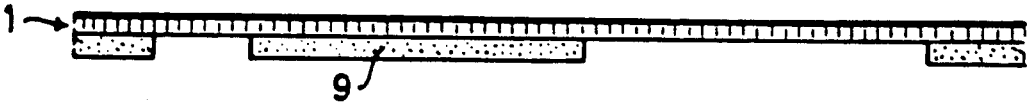
FIG. 3 is a diagrammatic sectional view taken through a photoconductor illustrating a third step of forming a color proof in accordance with a method of the invention.

The photoconductor 1 is then toned with a positive background toner of the invention which forms background toner deposits 9, as illustrated in FIG. 3.

Figure 4:
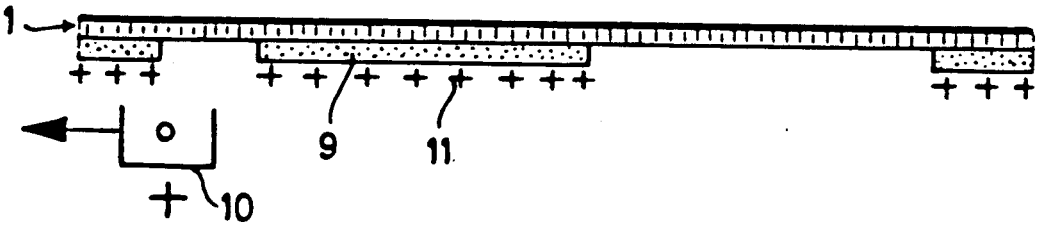
FIG. 4 is a diagrammatic sectional view taken through a photoconductor illustrating a fourth step of forming a color proof in accordance with a method of the invention.

FIG. 4 illustrates the step where the photoconductor 1 and the background deposits 9 are charged positively by means of a corona generator 10. Only the background deposits 9 accept positive charges 11, while the n-type photoconductor 1 remains uncharged. It is to be noted that this is an optional step that can be used to reduce the negative charge which would be accepted by the background deposits 9 in the following step illustrated in the next Figure.

Figure 5:
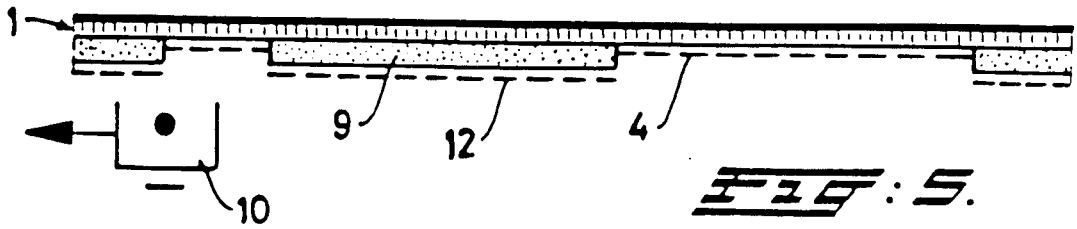
FIG. 5 is a diagrammatic sectional view taken through a photoconductor illustrating a fifth step of forming a color proof in accordance with a method of the invention.

FIG. 5 illustrates the step where the photoconductor 1 and the background deposits 9 are charged negatively. The negative charges 4 on the photoconductor 1 are of the same magnitude as in FIG. 1 that is needed for toner attraction. The magnitude of negative charges 12 on the background deposits 9, however, depends on whether or not the optional step illustrated in FIG. 4 has been carried out. Namely, if the background deposits 9 carry the positive charges 11 induced in the preceding optional step, the positive charges on the background deposits 9 at first have to be neutralized by this step of negative charging before the background deposits 9 can be actually charged negatively. In this case, the magnitude of negative charges induced in this step on the background deposits 9 would be considerably lower than in the case where the optional step is omitted.

Figure 6:
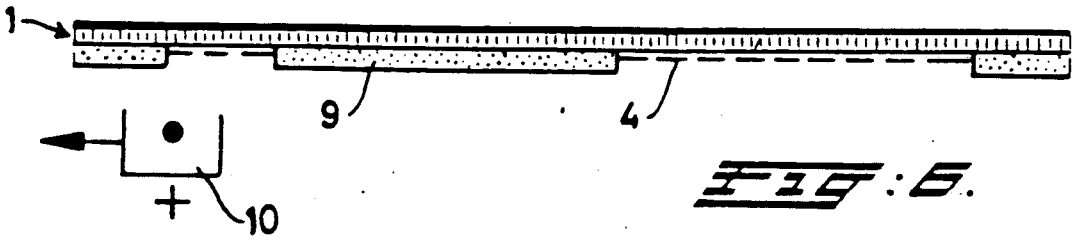
FIG. 6 is a diagrammatic sectional view taken through a photoconductor illustrating a sixth step of forming a color proof in accordance with a method of the invention.

FIG. 6 illustrates the step where the photoconductor 1 and the background deposits 9 are again charged positively. In this step, the positive charging current is selected to be low enough so as not to appreciably affect the negative charges on the high capacitance photoconductor 1, yet sufficient to substantially neutralize the negative charges 12 on the background deposits 9. This is possible due to the low capacitance and consequently, low surface charge density, of the background deposits 9. Moreover, if the optional step illustrated in FIG. 4 is performed, positive charges will be induced in the background deposits 9 to actually repel positive color toner therefrom in the following step of toning.

Figure 7:
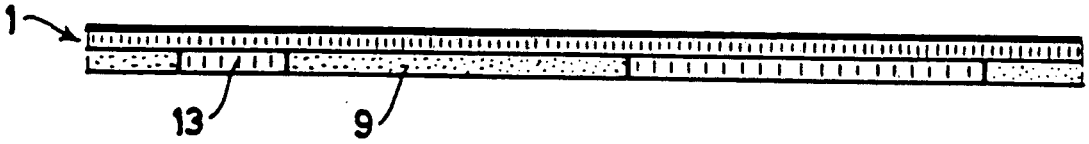
FIG. 7 is a diagrammatic sectional view taken through a photoconductor illustrating a seventh step of forming a color proof in accordance with a method of the invention.

The photoconductor 1 is then toned with a positive toner of a first color to form first color toner deposits 13 thereon, as illustrated in FIG. 7. Accordingly, no color toner is attracted to the background deposits 9.

Figure 8:
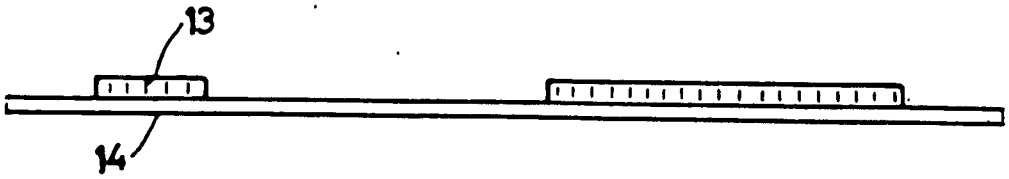
FIG. 8 is a diagrammatic sectional view taken through a receptor illustrating an eighth step of forming a color proof in accordance with a method of the invention.

FIG. 8 illustrates a receptor 14, such as paper, after electrostatic transfer of the first color image deposits 13 from the photoconductor 1 of FIG. 7 has taken place.

Figure 9:
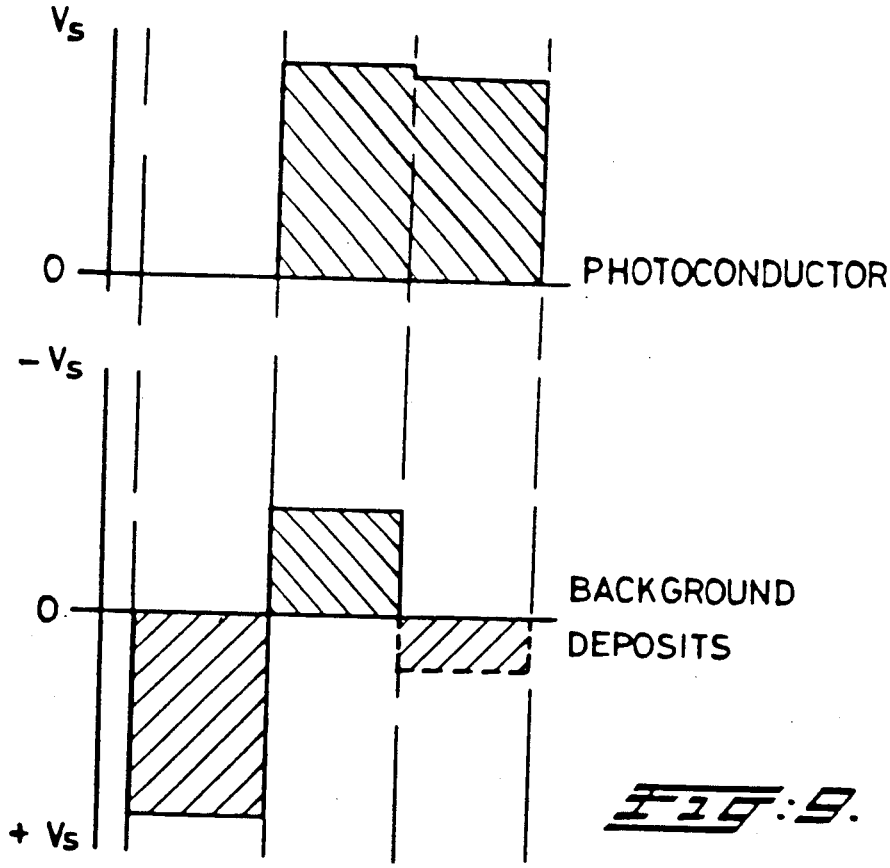
FIG. 9 is a bar graph illustrating the surface voltages on the photoconductor and the background deposits when step 5 is included.
Figure 10:
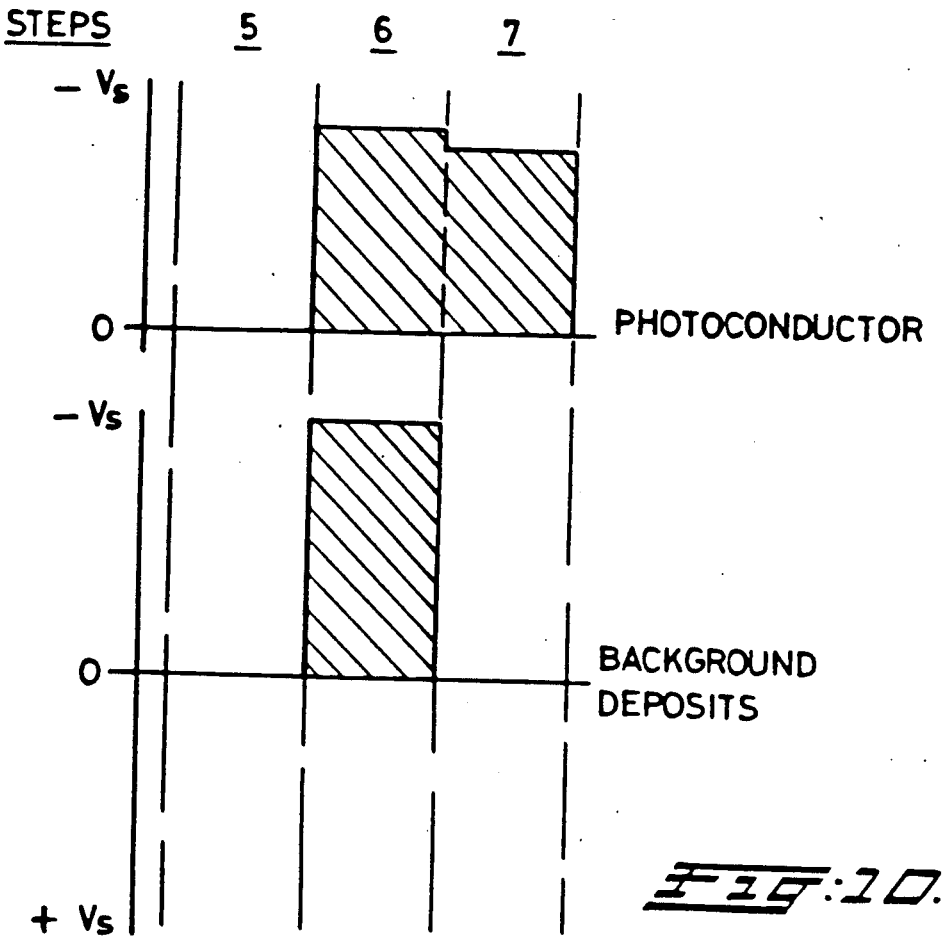
FIG. 10 is a bar graph illustrating the surface voltages on the photoconductor and the background deposits when step 5 is omitted.

FIGS. 9 and 10 illustrate the effects of charging in the steps described in FIGS. 4, 5, and 6 corresponding to process steps 5, 6, and 7 respectively. For simplicity, in FIGS. 9 and 10 the charging effects are illustrated in terms of the surface voltages Vs corresponding to the surface charges.

FIG. 9 illustrates the effect of the positive Vs induced on the background deposits 9 in optional step 5. In step 6, the photoconductor 1 is charged negatively to the top Vs, while the negative Vs induced on the background deposits 9 is relatively low. Consequently, at very low positive charging current in step 7, the negative Vs on the background deposits 9 is reduced to zero, or even a positive Vs is induced thereon, as shown by the dotted lines in FIG. 9, while the negative top Vs on the photoconductor 1 remains virtually unaffected.

If optional step 5 is omitted, as illustrated in FIG. 10, the negative Vs induced on the background deposits 9 in step 6 is high. In this case a higher current is needed for positive charging in step 7 to reduce the negative Vs on the background deposits 9 to zero. At the same time, this results in a greater drop in the top Vs on the photoconductor.

Reusable photoconductors which are suitable for a colorproofing process in accordance with this invention can be, for example, crystalline sputtered cadmium sulfide as disclosed, for example, in U.S. Pat. No. 4,025,339. Other reusable photoconductors can be used if so desired.

The colorproofing process of this invention can be conveniently carried out in electrophotographic color proofing equipment as described, for example, in U.S. Pat. Nos. 4,556,309 and 4,557,583, which were referred to above and which were operated with the above referred to crystalline cadmium sulfide photoconductor on a stainless steel substrate to prepare the data for the illustrative examples given further below.

It should be noted that in the above referred to colorproofing equipment, electrostatic transfer is effected by means of rollers and the toner deposits are transferred from the photoconductor first to an offset or intermediate member and then to the receptor proof paper. For simplicity, however, in the following examples reference is made only to a single transfer from the photoconductor to a paper receptor. It is to be noted that double transfer through an offset or intermediate member is equally applicable as well as electrostatic transfer by other means, such as, for example, by corona discharge.

Liquid toner compositions forming electrostatically transferable color deposits useful in the colorproofing process of this invention are disclosed, for example, in U.S. Pat. No. 3,419,411 and in co-pending U.S. Pat. application entitled "Method Of Image Fixing In Color Electrostatography", Ser. No. 920,510, filed Oct. 17, 1986 and owned by the same assignee as this application. These are incorporated herein by reference.

The following examples will serve to further illustrate the process of this invention.

COMPARATIVE EXAMPLE 1

This example is included to illustrate the nonconductive nature of the background deposits 9 of this invention and the image quality obtainable if positive charging as proposed in optional step 5 and in step 7 is not employed.

The background toner in this and the following examples included a dispersion of pigment grade calcium carbonate and about 20 percent by weight acrylic dispersing aid in isoparaffinic hydrocarbon carrier liquid.

The same color toners were employed throughout all examples, also in isoparaffinic hydrocarbon carrier liquid, and the printing sequence was black, yellow, magenta and cyan.

Throughout all examples colorproofs were produced on a high quality clay coated art paper.

After all of the required color toner deposits 13 were transferred to the receptor paper 14, it was coated by spraying with a clear acrylic polymer layer to transparentize the color toner deposits 13 and to fuse them to the receptor 14, as described earlier. Equal transparentization and fusion was obtained by spraying the receptor with a pure solvent to thereby dissolve the clear polymeric binder in the color toner deposits 13, without affecting the appearance of the receptor 14 in nonimage areas, as disclosed in said aforementioned copending U.S. Pat. application, Ser. No. 920,510.

To match the press printed subject matter on the same art paper, the densities of the colors on the proof had to be within ±0.05 tolerance as follows:

black—1.80
yellow—0.90
magenta—1.45
cyan—1.35, at 0.00 fog density in the background areas. All densities were measured with a Macbeth 927 wide band reflection densitometer.

For electrostatic transfer of the color toner deposits 13 to the art paper the following voltages were used throughout: for black—500 V, for yellow—900 V, for magenta and cyan—1500 V. At these voltages there was no appreciable transfer of the background deposits 9 to the art paper.

It should be noted that in the previously referred to colorproofing equipment used in these examples, the time lapse between negatively charging the photoconductor 1 and commencement of background toning is about 100 seconds. Also, the time lapse between negative charging in step 6 and commencement of color toning is about 100 seconds, and the charges or surface voltages on the photoconductor 1 and on the background deposits 9 at such time determine the density which the color toners develop during the following toning step.

In all examples the photoconductor was charged negatively for background toning and then in step 6 for color toning with a corona current of 350 microamps. This induced a top surface voltage on the photoconductor 1 of 30 V, which in 100 seconds decayed to 28 V.

In this comparative example where steps 5 and 7 were omitted, the negative charging in step 6 induced on the background deposits 9 a surface voltage of 50 V, which in 100 seconds decayed to 20 V.

Applying 28 V on the photoconductor 1 and 20 V on the background deposits 9 at commencement of color toning gave the following densities:

| Image | Fog |
|---|---|
| black - 1.90 | 0.08 |
| yellow - 1.00 | 0.05 |
| magenta - 1.50 | 0.15 |
| cyan - 1.43 | 0.05 |

The cumulative 4-color fog density was 0.25 to 0.30.

The high voltage of 20 V on the background deposits 9 in view of its low capacitance and consequently low surface charge density attracted relatively little color toner, however the thus caused fog level was sufficient to render the proof completely unacceptable.

EXAMPLE 2

Comparative Example 1 was repeated with the exception that optional step 5 and step 7 were carried out.

In step 5, the photoconductor 1 and the background deposits 9 were charged positively with 200 microamps corona current. This induced a positive surface voltage of about 50 V on the background deposits 9.

Step 6 of negative charging immediately followed step 5. In this instance the negative surface voltage induced on the background deposits 9 was only about 30 V.

In the immediately following step 7, the photoconductor 1 and the background deposits 9 were charged positively with a corona current of 50 microamps, which reduced the negative voltage on the background deposits 9 to zero. The top surface voltage on the photoconductor 1 was reduced by only 1 V to 29 V, which in 100 seconds decayed to 27 V.

Applying 27 V on the photoconductor 1 and 0 V on the background deposits 9 at commencement of color toning gave the following densities:

| Image | Fog |
|---|---|
| black - 1.85 | 0.00 |
| yellow - 0.95 | 0.00 |
| magenta - 1.48 | 0.00 |
| cyan - 1.39 | 0.00 |

The thus produced colorproof was fully acceptable.

EXAMPLE 3

Example 2 was repeated with the exception that in step 7 the positive corona current was 60 microamps. This induced a positive voltage on the background deposits 9 of 12 V, which in 100 seconds decayed to 5 V. The top surface voltage on the photoconductor 1 was reduced by 2 V to 28 V, which in 100 seconds decayed to 26 V.

Applying 26 V on the photoconductor 1 and 5 V positive on the background deposits 9 at commencement of color toning gave the following densities:

| Image | Fog |
|---|---|
| black - 1.82 | 0.00 |
| yellow - 0.92 | 0.00 |
| magenta - 1.45 | 0.00 |
| cyan - 1.36 | 0.00 |

The thus produced colorproof was fully acceptable.

EXAMPLE 4

Comparative Example 1 was repeated with the exception that step 7 was included.

In step 7, the positive corona current had to be 75 microamps to reduce the negative charge on the background deposits 9 to zero. However, this reduced the top negative surface voltage on the photoconductor 1 to 26 V, which in 100 seconds decayed to 24 V.

Applying 24 V on the photoconductor 1 and 0 V on the background deposits 9 at commencement of color toning gave the following densities:

| Image | Fog |
|---|---|
| black - 1.77 | 0.00 |
| yellow - 0.86 | 0.00 |
| magenta - 1.40 | 0.00 |
| cyan - 1.30 | 0.00 |

The color densities were lower that in the preceding examples, but still within the specified tolerance limits. The colorproof was fully acceptable.

There has been described a novel electrophotographic process for the production of positive colorproofs from negative color separation films. The materials and equipment disclosed herein are intended to be construed in illustrative sense only without restricting the scope of this invention.

What is claimed and desired to be secured by letters patent of the United States is:

1. An image reversal process for the production of positive color imagery from negative color separation films comprising the steps of:

a) uniformly charging a photoconductor to a first polarity;

b) exposing said photoconductor to light through a negative separation film of the first color;

c) toning said photoconductor with opposite polarity liquid background toner to form in unexposed areas a background deposit thereon;

d) drying said background deposit;

e) uniformly charging said photoconductor and said background deposit to said first polarity;

f) uniformly applying charges of opposite polarity to said photoconductor and said background deposit, the magnitude of said opposite polarity charges being selected to substantially reduce the first polarity charges on said background deposit without substantially affecting the first polarity charges on said photoconductor;

g) toning said photoconductor with opposite polarity liquid toner of the first color to form color deposits thereon in image areas free of said background deposit;

h) transferring said color deposits onto a receptor;

i) removing said background deposit from said photoconductor; and j) repeating steps a) to i) with negative separation films of subsequent colors and liquid toners of corresponding colors.

2. The process as defined in claim 1 wherein in step f) the magnitude of said opposite polarity charges is selected to substantially reduce the first polarity charges on said background deposit and induce charges of opposite polarity thereon, without substantially affecting the first polarity charges on said photoconductor.

3. The process as defined in claim 1 wherein said dried background deposit on said photoconductor remains on said photoconductor during the required process steps, without being adhesively affixed thereto, until removed therefrom by cleaning; is chargeable to positive and negative polarity; has a lower capacitance than said photoconductor; is substantially non-transferable electrostatically at least at the voltages at which the color toner deposits used in the process are transferred; and becomes transparent upon random transfer to the receptor when a clear polymer film is formed over said background deposit and said receptor.

4. The process as defined in claim 1 wherein said photoconductor is chargeable to one polarity only.

5. The process as defined in claim 1 wherein in step f) the substantial reduction of said first polarity charges on said background deposit, without substantially affecting said first polarity charges on said photoconductor, is due to the capacitance of said background deposit being lower than the capacitance of said photoconductor.

6. The process as defined in claim 1, wherein after step h) while using said background deposit formed in steps c) and d), steps e) to h) are repeated to image a multiplicity of receptors.

7. The process as defined in claim 1 wherein said photoconductor is reusable.

8. The process as defined in claim 1 wherein the composition of said background deposit includes particulate material and a dispersing aid for said particulate material and wherein the proportion of said dispersing aid is about 20–25 percent by weight of said particulate material.

9. The process as defined in claim 8 wherein said composition of said background deposit includes a charge director.

10. The process as defined in claim 1 wherein said receptor is dried upon transfer thereto of toner deposits of all required colors.

11. The process as defined in claim 1 wherein after transfer of toner deposits of all required colors to said receptor a clear polymer film is formed over said receptor, at least in the areas containing said color toner deposits thereon.

12. The process as defined in claim 1 wherein said receptor is proofing stock material for the production thereon of a multicolor pre-press proof.

13. An image reversal process for the production of positive color imagery from negative color separation films comprising the steps of:

a) uniformly charging a photoconductor to a first polarity;

b) exposing said photoconductor to light through a negative separation film of the first color;

c) toning said photoconductor with opposite polarity liquid background toner to form in unexposed areas a background deposit thereon;

d) drying said background deposit;

e) applying charges of opposite polarity to said photoconductor and said background deposit to thereby induce charges of opposite polarity only on said background deposit;

f) uniformly charging said photoconductor and said background deposit to said first polarity, wherein said first polarity charges induced on said background deposit are limited by said opposite polarity charges induced thereon in preceding step e);

g) uniformly applying charges of opposite polarity to said photoconductor and said background deposit, the magnitude of said opposite polarity charges being selected to substantially reduce the first polarity charges on said background deposit, without substantially affecting the first polarity charges on said photoconductor;

h) toning said photoconductor with opposite polarity liquid toner of the first color to form color deposits thereon in image areas free of said background deposit;

i) transferring said color deposits onto a receptor;

j) removing said background deposit from said photoconductor; and k) repeating steps a) to j) with negative separation films of subsequent colors and liquid toners of corresponding colors.

14. The process as defined in claim 13, wherein in step g) the magnitude of said opposite polarity charges is selected to substantially reduce the first polarity charges on said background deposit and induce charges of opposite polarity thereon, without substantially affecting the first polarity charges on said photoconductor.

15. The process as defined in claim 13, wherein said dried background deposit on said photoconductor remains on said photoconductor during the required process steps, without being adhesively affixed thereto, until removed therefrom by cleaning; is chargeable to positive and negative polarity; has a lower capacitance than said photoconductor; is substantially non-transferable electrostatically at least at the voltages at which the color toner deposits used in the process are transferred; and becomes transparent upon random transfer to the receptor when a clear polymer film is formed over said background deposit and said receptor.

16. The process as defined in claim 13 wherein said photoconductor is chargeable to one polarity only.

17. The process as defined in claim 16 wherein in step e) the induction of opposite polarity charges only on said background deposit is due to said photoconductor being chargeable to said first polarity only.

18. The process as defined in claim 13 wherein in step g) the substantial reduction of said first polarity charges on said background deposit, without substantially affecting said first polarity charges on said photoconductor, is due to the capacitance of said background deposit being lower than the capacitance of said photoconductor.

19. The process as defined in claim 13, wherein after step i) while using said background deposit formed in steps c) and d), steps e) to i) are repeated to image a multiplicity of receptors.

20. The process as defined in claim 13 wherein said photoconductor is reusable.

21. The process as defined in claim 13 wherein the composition of said background deposit includes particulate material and a dispersing aid for said particulate material and wherein the proportion of said dispersing aid is about 20–25 percent by weight of said particulate material.

22. The process as defined in claim 21 wherein the composition of said background deposit includes a charge director.

23. The process as defined in claim 13 wherein said receptor is dried upon transfer thereto of toner deposits of all required colors.

24. The process as defined in claim 13 wherein after transfer of toner deposits of all required colors to said receptor a clear polymer film is formed over said receptor, at least in the areas containing said color toner deposits thereon.

25. The process as defined in claim 13 wherein said receptor is proofing stock material for the production thereon of a multicolor pre-press proof.

26. An image reversal process for the production of positive color imagery from at least one negative color separation film comprising the steps of:

a) uniformly charging a photoconductor to a first polarity;

b) exposing said photoconductor to light through a negative separation film of the at least one color;

c) toning said photoconductor with opposite polarity liquid background toner to form in unexposed areas a background deposit thereon;

d) drying said background deposit;

e) uniformly charging said photoconductor and said background deposit to said first polarity;

f) uniformly applying charges of opposite polarity to said photoconductor and said background deposit, the magnitude of said opposite polarity charges being selected to substantially reduce the first polarity charges on said background deposit without substantially affecting the first polarity charges on said photoconductor;

g) toning said photoconductor with opposite polarity liquid toner of the first color to form color deposits thereon in image areas free of said background deposit;

h) transferring said color deposits onto a receptor; and i) removing said background deposit from said photoconductor.

27. The process as defined in claim 26 including, after step d), applying charges of opposite polarity to said photoconductor and said background deposit to thereby induce charges of opposite polarity only on said background deposit, wherein said first polarity charges induced on said background deposit in step e) are limited by said opposite polarity charges induced thereon.

28. The process as defined in claim 27 wherein in step f) the magnitude of said opposite polarity charges is selected to substantially reduce the first polarity charge on said background deposit and induce charges of opposite polarity thereon, without substantially affecting the first polarity charges on said photoconductor.

* * * * *